United States Patent [19]

Olds et al.

[11] Patent Number: 4,517,756

[45] Date of Patent: May 21, 1985

[54] SNUBBER FOR DIPPER DOOR

[75] Inventors: John R. Olds, Schererville, Ind.; Mark R. Alt, Chicago Heights, Ill.

[73] Assignee: Abex Corporation, Stamford, Conn.

[21] Appl. No.: 629,651

[22] Filed: Jul. 11, 1984

[51] Int. Cl.[3] ..... E02F 3/46

[52] U.S. Cl. ..... 37/118 R; 267/153; 414/726

[58] Field of Search ..... 37/118 R, 118 A; 267/21 R, 21 A, 173, 153; 414/726, 722, 720, 704

[56] References Cited

U.S. PATENT DOCUMENTS

| | | | |
|---|---|---|---|
| 146,325 | 1/1874 | Eaton . | |
| 2,160,432 | 5/1939 | Davidson . | |
| 2,434,902 | 1/1948 | Burdick . | |
| 2,561,518 | 7/1951 | Larsen | 37/118 R |
| 2,604,221 | 7/1952 | Edwards et al. . | |
| 2,641,792 | 6/1953 | Peeler . | |
| 2,735,559 | 2/1956 | Burdick et al. . | |
| 2,840,253 | 6/1958 | Thompson . | |
| 3,583,693 | 6/1971 | Johnston | 267/153 |
| 3,795,392 | 3/1974 | Nemec | 267/153 X |
| 4,006,832 | 2/1977 | Auxer et al. | 37/118 R X |
| 4,063,373 | 12/1977 | Greer et al. | 37/115 |
| 4,443,957 | 4/1984 | Novotny et al. | 37/118 R |

FOREIGN PATENT DOCUMENTS

| | | |
|---|---|---|
| 406765 | 12/1924 | Fed. Rep. of Germany . |
| 541752 | 1/1932 | Fed. Rep. of Germany . |
| 1281960 | 10/1968 | Fed. Rep. of Germany . |

*Primary Examiner*—Clifford D. Crowder
*Attorney, Agent, or Firm*—Mueller and Smith

[57] ABSTRACT

A snubber for use with a dipper to retard movement of the dipper door toward and away from an opening formed in the dipper. The snubber includes an elastic member and an actuator link. When the door is at a first angle with respect to the dipper, the elastic member is in tension to retard movement of the door toward the dipper. When the door is at a second angle with respect to the dipper, the elastic member is in bending to retard movement of the door away from the dipper. The snubber is inactive when the door is at an angle between the first and second angles.

7 Claims, 5 Drawing Figures

SNUBBER FOR DIPPER DOOR

BACKGROUND OF THE INVENTION

This invention relates to a snubber for a dipper door. More specifically, it relates to a snubber which retards movement of the door when it is at certain angular positions with respect to an opening defined in the dipper.

Large excavator dippers have heavy doors which move to open or close an opening defined in the dipper. In a typical 15 cubic yard dipper the door weighs approximately 12,000 pounds. In operation, digging is begun with the door in a closed position. When the bucket is full of mined material, the dipper is elevated and rotated approximately 90° such that the door is approximately parallel with respect to the ground and moved to a discharge location, such as over a dump truck bed. The door then is released which permits it to pivot from the horizontal position to a substantially vertical position with respect to the ground to permit the mined material to be discharged through the opening. Subsequently, the bucket is rotated toward the door to cause the door to close the opening.

If movement of the heavy door is not retarded before it contacts the dipper on closing, it may slam into the dipper with such force that damage to the door, the door hinge, or the dipper will result. Likewise, if movement of the door is not retarded as it approaches the limit of its travel away from the opening, the door may slam into the handle causing damage to it or to the door. Consequently, it is desirable to have a device which will snub movement of the door when it approaches the dipper to close the opening or when it approaches the handle.

In the past, a number of snubbers have been developed which connect between the door and the dipper to retard movement of the door. The majority of these snubbers have incorporated springs, friction elements or hydraulic elements. Each of these has certain disadvantages in commercial use. For example, coil springs generally do not create sufficient force to retard door movement under all conditions and can be fouled by rocks which become wedged between coils. Hydraulic devices are subject to leakage and are easily damaged when struck by mined material. Friction devices require constant adjustment and have a relatively short useful life. One form of snubber which has proven effective and has eliminated many of the disadvantages of previous snubbers is one having a unitary elastic body which is described in detail in U.S. Pat. No. 4,443,957 which is assigned to the assignee of the instant invention. This device has an elastomeric working section which interconnects a pair of end lugs having mounting holes. The mounting holes are offset from the longitudinal center line of the working section and are attached by pivot pins to the dipper and to the door. In a position intermediate one extreme position in which the door closes the opening defined in the dipper and the other extreme position in which the door is approximately perpendicular with respect to the opening, the snubber is in an unstressed condition. As the door moves toward the opening the elastomeric working section is placed in tension to retard this movement. When the door is moved from the intermediate position toward the other extreme position the working section is placed in bending to retard this movement. Although the unitary elastic body snubber has eliminated many of the disadvantages found in other types of snubbers it has been found that in heavy usage it has a shorter than desired useful life.

Research has disclosed that one reason for the shorter than desired useful life of the elastic snubber is that the working section is stressed any time the door is moved from the intermediate position. It was found that the useful life of the snubber could be greatly increased if it were not stressed at all angular positions of the door with respect to the opening but instead is placed in tension to retard movement of the door toward the dipper only when the door was within a first specified angular position with respect to the opening, is placed in bending to retard movement of the dipper arm away from the dipper only when the angle of the door with respect to the opening exceeds a second specified angular position, and is unstressed when the door is between the two positions.

SUMMARY OF THE INVENTION

The instant invention provides a snubber for use with a dipper which includes means defining an opening and a door pivotally connected to the dipper which in one position closes the opening. The snubber includes an elongated elastic member and an actuator link. One end of the elastic member is pivotally connected to the dipper, one end of the link is pivotally connected to the door and the other end of the member is pivotally connected to the other end of the link. A first means is provided for preventing pivotal movement of the link in one direction when the door is at or within a first angle with respect to the means defining the dipper opening to thereby place the elastic member in tension to retard door movement when the door is moved toward the opening and is at an angle less than the first angle and second means are provided for preventing pivotal movement of the actuator link in the other direction to set a second angle of the door with respect to the means defining the dipper opening at which the elastic member will be placed in bending to retard door movement when the door is removed away from the opening at an angle greater than the second angle and the elastic member is unstressed when the door is at an angle with respect to the opening which is between the first and second angles.

DESCRIPTION OF THE PREFERRED EMBODIMENT

Figure 1:
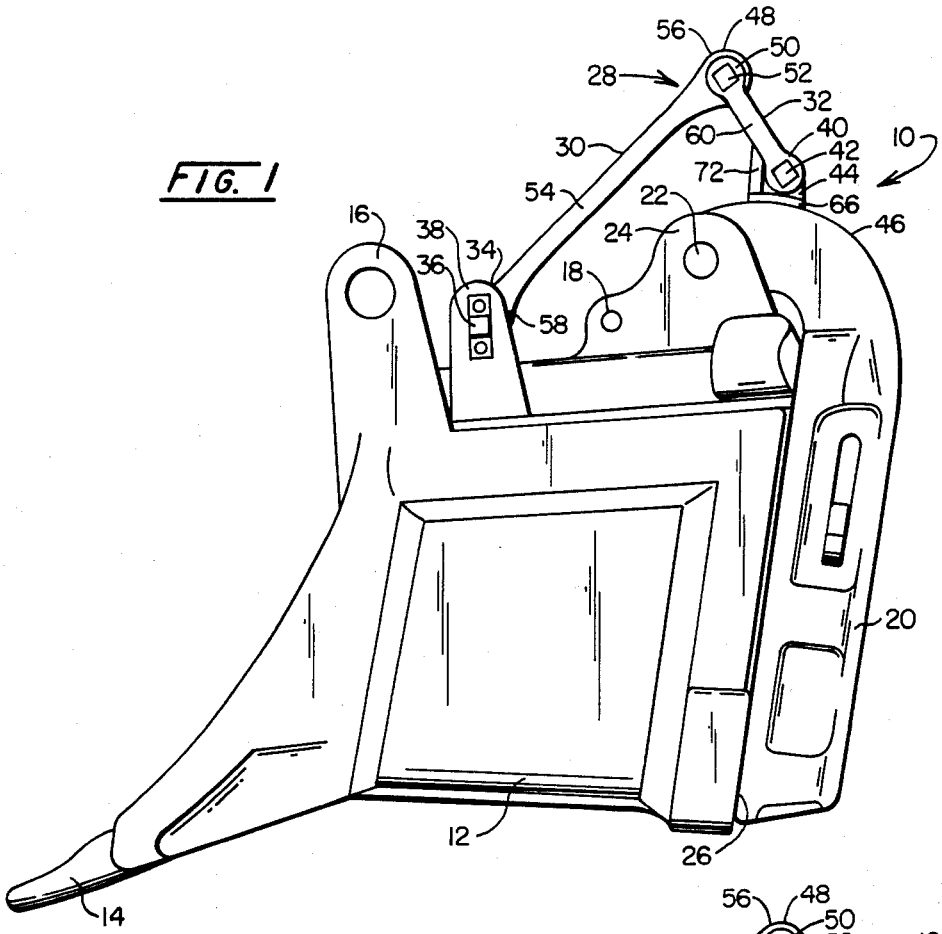
FIG. 1 is a side view of a dipper shown in a digging position with the door closed and the elastic member of the snubber in tension.

FIG. 1 shows a dipper assembly 10 which comprises a body 12 having digging teeth 14 adjacent an opening formed in the front thereof. A pair of front side bosses 16 (one shown) are provided on the upper surface of the dipper to pivotally attach the dipper to a conventional boom bail pivot pin (not shown) and a pair of mid side bosses 18 (one shown) are provided to pivotally attach the dipper to a conventional excavator handle (not shown). A door 20 is located at the rear of body 12 and is pivotally attached thereto by a pair of pivot pins 22 retained in bosses 24 (one shown) formed on each side of the upper surface of the dipper. Door 20 is movable to open and close an opening defined by a wall 26 in the rear of the dipper. The door is retained in the closed position during digging operations by a latch bar (not shown). To open the door, a conventional remote operator (not shown) is actuated to release the latch bar.

A pair of snubbers 28 (one shown) according to this invention are provided to retard extreme movements of door 20. Each snubber 28 includes an elongated, unitary, elastic member 30 and an actuator link 32. One end 34 of elastic member 30 is pivotally attached to dipper body 12 by a pivot pin 36 mounted in a bracket 38 affixed to the upper surface of the body. One end 40 of actuator link 32 is pivotally attached to door 20 by a pivot pin 42 carried in a bracket 44 described in detail hereinafter which is mounted on a hinge portion 46 of door 20. The other end 48 of elastic member 30 is pivotally connected to the other end 50 of actuator link 32 by a pivot pin 52.

Figure 2:
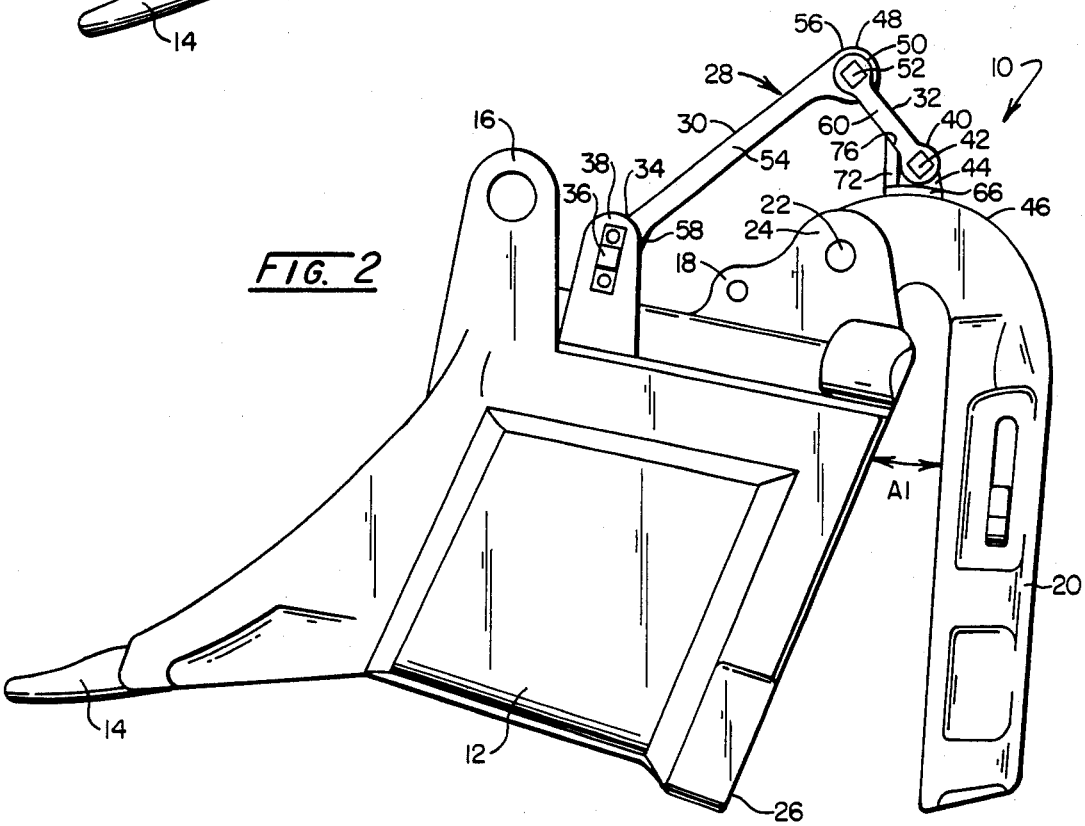
FIG. 2 is a side view of the dipper shown in FIG. 1 in which the door is at first in an angular position with respect to the opening in which further counterclockwise movement of the actuator link of the snubber is prevented and further movement of the door toward the opening will tension the elastic member of the snubber.
Figure 3:
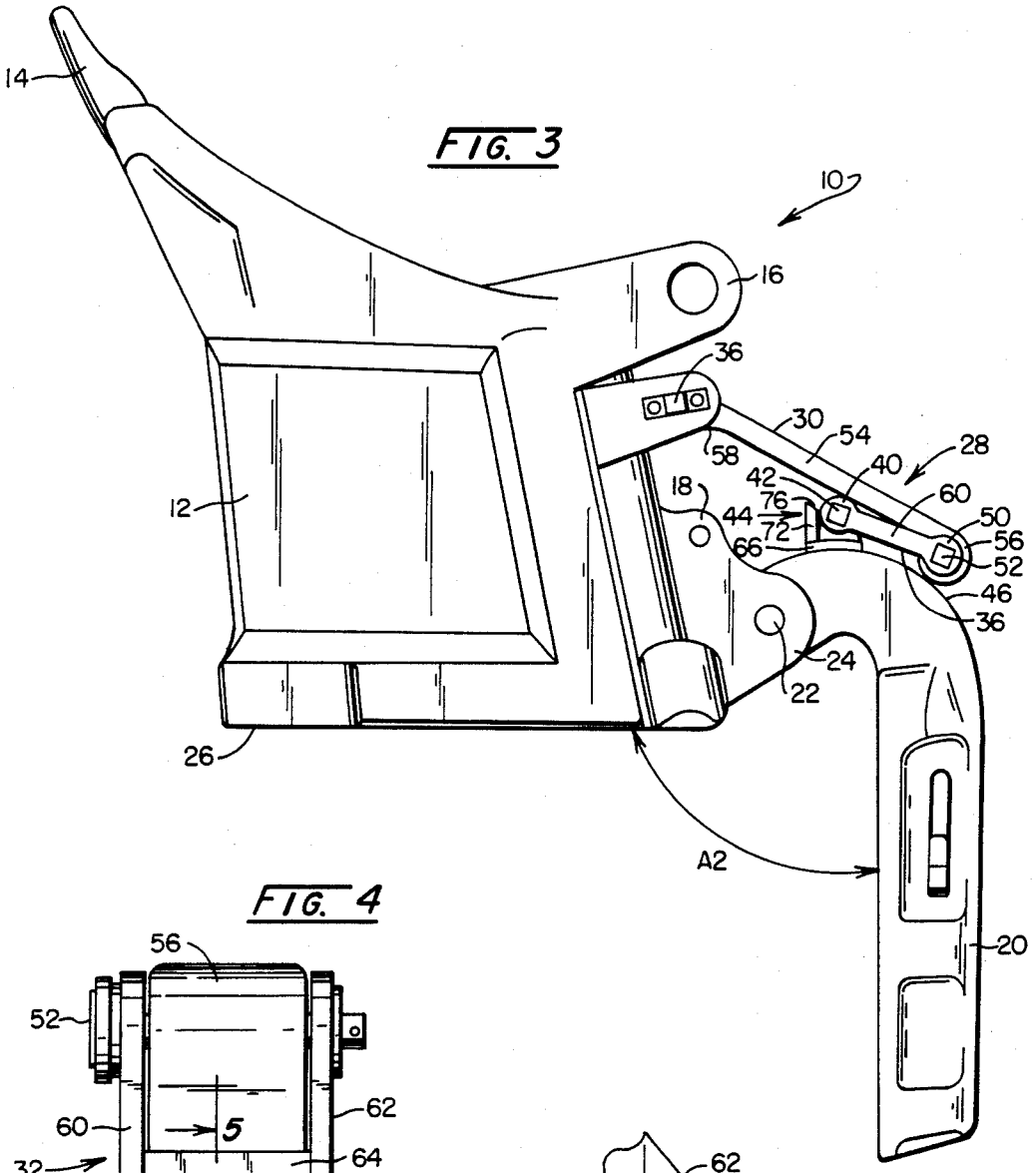
FIG. 3 is a side view of a dipper shown in a dumping position in which the door is at the maximum desired angle with respect to the opening, the door just engages the snubber and further pivotal movement of the door away from the opening will place the elastic member of the snubber in bending.

Referring to FIGS. 1–3, elastic member 30 includes an elongated elastic working section 54 having a lug 56, 58 formed in each end 48, 34, respectively. Lug 56 has a hole which receives pivot pin 52 and lug 58 has a hole which receives pivot pin 36. In the preferred embodiment elongated elastic working section 54 and lugs 56, 58 are a unitary casting formed of a homogeneous elastomeric material. Lugs 56, 58 are sized such that lug 56 projects radially beyond the other end 50 of actuator link 32. Additionally, in the preferred embodiment, elastic member 30 is symmetrical about a transverse section taken through its mid point and lugs 56, 58 are laterally offset to one side of the axial center line of working section 54. If elastic member 30 is symmetrical, either end 34, 48 can be pivotally affixed to either the body 12 or the door 20. Although in the preferred embodiment elastic member 30 is a unitary, elastomeric member, for purposes of the instant invention, member 30 need only have an elastic working section 54 intermediate lugs 56, 58. Additionally, it is not necessary that the lugs 56, 58 be laterally offset from the longitudinal center line of working section 54.

Figure 4:
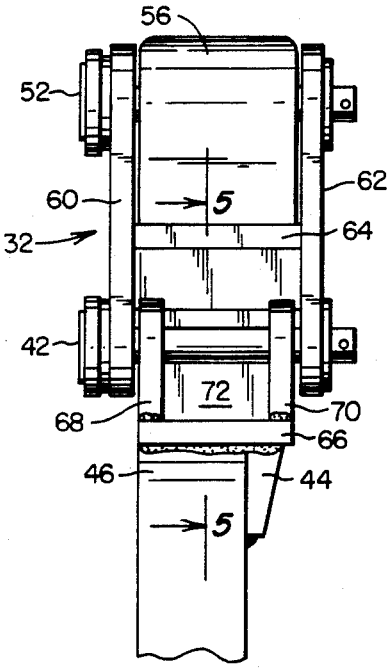
FIG. 4 is a plan view of the snubber actuator link in the position shown in FIG. 2.

Referring to FIG. 4, actuator link 32 is an H-shaped structure which includes a pair of parallel arms 60, 62 which are joined by a lateral cross-member 64. Each arm 60, 62 is bone shaped and each end of each arm 60, 62 has a bore for receiving pivot pins 42, 52, respectively.

Figure 5:
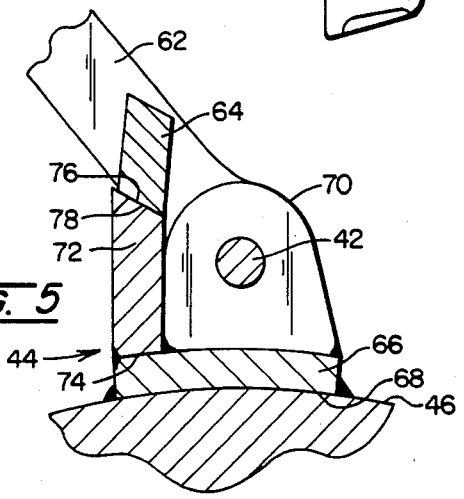
FIG. 5 is a transverse sectional view along line 5—5 of FIG. 4.

An enlarged view of bracket 44 which connects one end of each arm 60, 62 of actuator link 32 to hinge portion 46 of door 20 is shown in FIG. 5. Bracket 44 includes a curved base member 66 having an inner face 68 which complements the curvature of hinge portion 46. A pair of parallel, upstanding arms 68, 70 are welded to base 66 and each has an aligned lateral bore which receives pin 42 which pivotally mounts arms 60, 62 of actuator link 32. A lateral stop 72 abutts each bracket arm 68, 70 and has an inner end 74 welded to base 66. Lateral stop 72 has a slanted outer end 76 which engages a similarly slanted surface 78 on the bottom side of lateral cross member 64 of actuator link 32 to limit counter-clockwise rotation thereof as will be discussed hereinbelow.

Operation of snubber 28 will now be described. Referring to FIG. 2, dipper door 20 is positioned at an angle A1 with respect to the opening defined by wall 26 in the rear portion of body 12. In the instant invention it has been found that the preferred value of angle A1 is about 15° to 30° depending upon the dimensions of the particular dipper. At this angular position actuator link 32 is positioned such that lateral stop 72 engages cross member 64 of link 32 to prevent further counter-clockwise rotation thereof. Elastic member 30 is unstressed. As door 20 moves from the position shown in FIG. 2 to that shown in FIG. 1, i.e. through an angle less than angle A1, lateral stop 72 causes actuator link 32 to pivot clockwise as door 20 pivots clockwise about pivot pin 22 and working section 54 of elastic member 30 is placed in tension which resists or retards movement of door 20 toward the opening defined by wall 26. When door 20 closes the opening, angle A1 is approximately 0° and door 20 is latched to retain it in position.

After door 20 closes the opening the dipper assembly 10 is filled with material and body 12 is pivoted to a position in which the opening defined by wall 26 and door 20 are approximately horizontal with respect to the ground as shown in FIG. 3. When the latch is released to permit door 20 to move away from the opening, the elastic member 30 which is under tension until door 20 reaches angle A1, tends to assist in opening door 20 as it returns to its unstressed state.

Snubber 28 is inactive when the door is at an angle greater than A1 until door 20 reaches the position of angle A2 with respect to the opening. Movement of door 20 away from the opening beyond angle A2 must be retarded to prevent door 20 from hitting the dipper handle. To this end, snubber 28 is positioned such that when door 20 is at angle A2 lug 56 of elastic member 30 contacts hinge portion 46 of door 20. Further rotation of door 20 away from the opening causes the elastic working section 54 of member 30 to go into bending which resists or retards movement of the door in this direction. Since the dimensions of each dipper are different, the angular position A2 of door 20 at which it engages the snubber 28 must be determined for each application. Angle A2 is typically 60°–90°. Because lugs 56, 58 are offset with respect to elastic working section 54 of elastic member 30 working section 54 tends to bow outwardly, away from door 20 and actuator link 32 when it is placed in bending. Additionally, because lugs 56, 58 are larger than the end portion of actuator link 32, lug 56 engages hinge portion 46 of door 20 rather than the end 50 of actuator link 32. This is desirable because lug 56 is preferably made of a resilient material which decreases the impact between the lug 56 and hinge portion 46.

Referring to FIG. 2, angle A1 is determined by the lengths of elastic member 30 and actuator link 32 and the positions of brackets 38, 44 and lateral stop 72. From FIG. 3, it is apparent that angle A2 at which door 20 engages lug 56 of elastic member 30 is likewise determined by the relative lengths of elastic member 30 and actuator link 32 and the position of brackets 38, 44. It can be seen that clockwise movement of actuator link 32 is prevented when elastic member 30 contacts the one end 40 of actuator link 32 contained in bracket 44.

From the above, it is apparent that elastic member 30 of snubber 28 is unstressed when door 20 is positioned between angle A1 and angle A2 and movement of door 20 is unrestrained therebetween. Consequently, if angle A2 is 80° and angle A1 is 20°, door 20 is unrestrained and snubber 28 is inactive during 60° of angular movement of door 20.

This means elastic member 30 is stressed during the critical portions of the travel of door 20 i.e. just before it closes the opening and just before it reaches the handle but is unstressed during the major portion of the travel. This greatly increases the life of the elastic member 30.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. A snubber for use with a dipper which includes means defining an opening and a door pivotally connected to the dipper which in one position closes the opening, characterized by the snubber having an elongated member with an elastic working section and an actuator link wherein one end of the member is pivotally connected to the dipper, one end of the link is pivotally connected to the door, and the other end of the member is pivotally connected to the other end of the link, means for preventing pivotal movement of the link in one direction when the door is at a first angle with respect to the means defining the dipper opening to thereby place the elastic working section of the elongated member in tension to retard door movement when the door is moved toward the opening and is at an angle less than the first angle and wherein the elongated member cooperates with the actuator link to define a second angle of the door with respect to the means defining the dipper opening at which the door engages the elongated member and the elongated member is placed in bending to retard door movement when the door is moved away from the opening at an angle greater than the second angle and the elastic working section of the elongated member is unstressed when the door is at an angle with respect to the opening which is between the first and second angles.

2. The snubber of claim 1, wherein the first pivot preventing means includes an outwardly projecting stop member mounted on the dipper door which engages the actuator link.

3. The snubber of claim 1, wherein the first angle is less than about 30 degrees.

4. The snubber of claim 3 wherein the second angle is greater than about 70 degrees.

5. The snubber of claim 1, wherein the elongated member includes a pair of elastic end lugs, one end lug forming part of the pivotal connection of the member with the dipper, the other end lug forming part of the pivotal connection with the actuator link other end, wherein the other end lug engages the door when the door is removed from the opening at an angle greater than the second angle.

6. The snubber of claim 1 wherein the actuator link includes a pair of spaced parallel arms and a lateral cross member, and the other end lug of the elastic member is received between the spaced parallel arms at the other end thereof.

7. A snubber for use with a dipper which includes means defining an opening and a door pivotally connected to the dipper which in one position closes the opening, characterized by the snubber having an elongated, unitary, elastic member with a pair of elastic end lugs and an actuator link, the actuator link comprising a pair of parallel spaced arms joined by a lateral cross link, the elastic member being symmetrical about a transverse cross section through its mid point, the end lugs being offset from the longitudinal axis of the elastic member, wherein one end of the member is pivotally connected to the dipper, one end of the link is pivotally connected to the door, and one elastic end lug of the member is received between the spaced arms and pivotaly connected to the other end of the link, stop means mounted on the door for engaging the actuator link and preventing pivotal movement of the link in one direction when the door is at a first angle with respect to the means defining the dipper opening to thereby place the elastic member in tension to retard door movement when the door is moved toward the opening at an angle less than the first angle and wherein the elastic member cooperates with the actuator link to define a second angle of the door with respect to the means defining the dipper opening at which further pivotal movement of the door away from the opening causes the door to engage the elastic end lug of the elastic member and place the elastic member in bending to retard door movement when the door is removed from the opening at an angle greater than the second angle and the elastic member is unstressed when the door is at an angle with respect to the opening which is between the first and second angles.

* * * * *